United States Patent [19]

Bergthaller et al.

[11] Patent Number: 5,021,330

[45] Date of Patent: Jun. 4, 1991

[54] COLOUR PHOTOGRAPHIC RECORDING MATERIAL CONTAINING A COUPLER RELEASING A PHOTOGRAPHICALLY ACTIVE COMPOUND

[75] Inventors: Peter Bergthaller, Bergisch Gladbach; Thomas Krüger, Leverkusen; Rudolf Stolzenburg, Langenfeld, Fed. Rep. of Germany; Dirk Hübner, Colonge, all of

[73] Assignee: Agfa Gevaert Aktiengesellschaft, Leverkusen, Fed. Rep. of Germany

[21] Appl. No.: 554,700

[22] Filed: Jul. 18, 1990

[30] Foreign Application Priority Data

Aug. 1, 1989 [DE] Fed. Rep. of Germany ..... 3925438

[51] Int. Cl.[5] ..... G03C 7/36

[52] U.S. Cl. ..... 430/544; 430/557; 430/558; 430/957

[58] Field of Search ..... 430/558 A, 557, 544, 430/957

[56] References Cited

U.S. PATENT DOCUMENTS 3,841,880 10/1974 Kertel ..... 430/558 A 4,870,000 9/1989 Bergthaller et al. ..... 430/557

*Primary Examiner*—Richard L. Schilling

*Attorney, Agent, or Firm*—Connolly and Hutz

[57] ABSTRACT

High edge effects and interimage effects are obtained when DIR couplers of formula I are used in color photographic silver halide materials.

I

In Formula I, $R^1$ denotes alkyl, for example $C_4H_9$-t, aryl, for example p-alkoxyphenyl, NH-aryl or NH—NH—$R^3$;

$R^2$ denotes H, halogen, e.g. chlorine, alkoxy, alkylthio or NH—$R^4$;

$R^3$ and $R^4$ denote acyl;

X denotes the residue of a photographically active compound containing a monocyclic 1,2,3- or 1,2,4-triazole ring, TIME denotes a linking member and n denotes 0 or 1.

7 Claims, No Drawings

COLOUR PHOTOGRAPHIC RECORDING MATERIAL CONTAINING A COUPLER RELEASING A PHOTOGRAPHICALLY ACTIVE COMPOUND

This invention relates to a colour photographic recording material having at least one light sensitive silver halide emulsion layer containing a coupler which releases a photographically active group, e.g. a development inhibitor, in the process of colour development.

It is known to carry out chromogenic development in the presence of compounds which in the process of development release imagewise diffusible substances capable of producing a particular effect, for example an influence on the development of silver halide. When the effect consists of inhibiting further development, such compounds are referred to as DIR compounds (DIR=-development inhibitor releasing). DIR compounds may be compounds which split off an inhibitor residue and then react with the oxidation product of a colour developer to form a dye (DIR couplers) or they may be compounds which release an inhibitor without at the same time forming a dye. The latter are regarded as DIR compounds in the strict sense. DIR couplers are known from, for example, U.S. Pat. No. -A-3 148 062, U.S. Pat. No. -A-3 227 554, U.S. Pat. No. -A-3 615 506, U.S. Pat. No. -A-3 617 291 and DE-A-24 14 006.

The diffusible, photographically active compounds released in the course of development may, however, consist, for example, of a dye, a coupler, a hardener, a silver halide solvent, a foggant, a development accelerator, a developer compound, a bleaching inhibitor, a bleaching accelerator, a mordant or a sensitizer.

The development inhibitors released are generally heterocyclic mercapto compounds or triazoles or benzotriazoles. For information on DIR compounds which undergo coupling reactions to give rise to substantially colourless products see, for example, U.S. Pat. No. -A-3 632 345, DE-A-23 59 295 and DE-A-25 40 959. DIR compounds are capable of producing numerous photographic effects which influence the quality of the image. These effects may be, for example, lowering of the gradation, production of a finer colour grain, improvement in the sharpness by the so called edge effect and improvement in the purity and brilliance of colour by so called interimage effects. See, for example, the publication entitled "Development Inhibitor Releasing (DIR) Couplers in Colour Photography" by C. R. Barr, J. R. Thirtle and P. W. Vittum, Photographic Science and Engineering 13, 74 (1969).

The DIR compounds which undergo colourless coupling have the advantage over DIR couplers which give rise to coloured products that they are universally usable so that one and the same compound may be used in all the light sensitive layers of a colour photographic recording material without regard to the colour produced whereas DIR couplers may generally only be used in some of the light sensitive layers on account of the colour produced by them if the colour side density caused by them is not acceptable in the other layers. Against this advantage of DIR compounds is, however, the disadvantage that they are generally less reactive than DIR couplers. In practice, therefore, only DIR couplers have in most cases been used and, if necessary, two or more different DIR couplers have been used in one and the same recording material. The various DIR couplers were in such cases associated with the various layers sensitized to different regions of the spectrum according to the colour produced by the couplers.

Rapid release of the photographically active compound from the coupler in the process of development is generally important, especially when the photographically active compound is required to influence the subsequent course of development. It is therefore highly desirable to use very active couplers. Important for this purpose is not only the group of photographically active compound attached as so called leaving group at the coupling position of the coupler but especially also the structure of the coupler itself. DIR couplers derived from α-heterocyclicly substituted acetamides are disclosed in JP-A-52 082 423. Quinazolone acetanilide DIR couplers, which have outstandingly advantageous properties, are disclosed in EP-A-0 287 833.

It is an object of the present invention to achieve improvements in the general solubility and in the solubility in alkalis while retaining the advantageous properties of quinazolone acetanilides (high activity, high stability and ease of accessibility). It was surprisingly found that by replacing the carbonyl group of the quinazolone ring by a sulphone group (benzosulphone diazine ring) while retaining the other structural elements, the DIR couplers obtained have pK values from 2.5 to 3 units lower than those of the comparable quinazolone acetanilides.

This invention relates to a colour photographic recording material having at least one light sensitive silver halide emulsion layer and a coupler associated therewith which is capable of releasing a photographically active compound, characterised in that the coupler corresponds to the following formula I

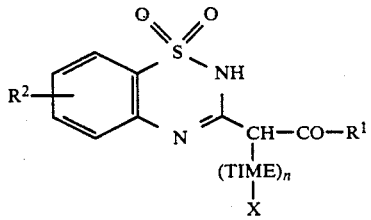

I wherein $R^1$ denotes alkyl, for example $C_4H_9$-t, aryl, for example p-alkoxyphenyl, NH-aryl or NH-NH-$R^3$;

$R^2$ denotes H, halogen, e.g. chlorine, alkoxy, alkylthio or NH-$R^4$;

$R^3$ and $R^4$ denote acyl;

X denotes the residue of a photographically active compound containing a monocyclic 1,2,3- or 1,2,4-triazole ring;

TIME denotes a linking member which is released together with the group X attached thereto when the coupler reacts with the oxidation product of a colour developer and in turn releases the group X as photographically active compound under the conditions of development;

n denotes 0 or 1.

An alkyl group denoted by $R^1$ in formula I may be straight chained or branched and substituted or unsubstituted and contains from 1 to 20 carbon atoms; methyl, ethyl, butyl, hexyl, dodecyl and in particular $C_4H_9$-t are examples of such groups.

An aryl group denoted by $R^1$ or contained in $R^1$ of formula I may in particular be phenyl or a phenyl group substituted e.g. with halogen, alkyl, alkoxy, acyl amino or sulphamoyl, e.g. p-alkoxyphenyl, o-alkoxyphenyl, 2-chloro-5-acylaminophenyl or 2-hexadecyloxy-5-(N-methyl)-sulphamoyl.

An acyl group denoted by $R^3$ or $R^4$ in formula I may be derived from an aliphatic or aromatic carboxylic acid or sulphonic acid, a carbamic acid or a sulphamic acid or from a carbonic acid semiester. Acyl groups derived from aliphatic carboxylic acids are preferred, e.g. alkylcarbonyl.

A linking member denoted by TIME in formula I is a group which after it has been split off from the coupling position of the coupler and while the coupler undergoes the coupling reaction with the oxidation product of the silver halide developer, it in turn capable of undergoing a reaction in which it releases a photographically active group attached thereto, in the present case a triazole of formula II. The group TIME is also described as a timing group because in the presence of such-a group, the photographically active residue attached thereto is in many cases released with some delay before it can become active. Examples of known timing groups include a group of the formula

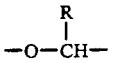

in which the oxygen atom is attached at the coupling position of the coupler and the carbon atom is attached to a nitrogen atom of a photographically active compound (e.g. DE-A-27 03 145), a group which after separation from the coupler undergoes an intramolecular nucleophilic displacement reaction to release the photographically active compound (e.g. DE-A-28 55 697), a group in which an electron transfer may take place along a conjugated system after separation from the coupler, whereby the photographically active compound is released (e.g. DE-A-31 05 026) and a group of the formula

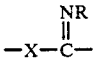

wherein X (e.g. —O—) is attached to the coupling position of the coupler and the carbon atom is attached to an atom of the photographically active compound and R may denote, for example, aryl (e.g. EP-A-0 127 063). The group TIME may also be a group which after separation from the coupling position of the coupler may itself undergo a coupling reaction or a redox reaction and may as a result of such a reaction release the group X attached thereto.

The releasable group X is the residue of a photographically active compound attached to the coupling position of the coupler or to the timing group TIME by a nitrogen atom of a 1,2,3- or a 1,2,4-triazole ring. Such a group X may correspond, for example, to the following formula

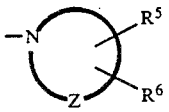

wherein

Z denotes the group required for completing a 1,2,3- or 1,2,4-triazole ring;

$R^5$ and $R^6$ denote H, alkyl, aryl, a hetertocyclic group, alkoxy, S-$R^7$, amino, acylamino, a carboxylic acid ester group or CO-$NR^8R^9$ and at least one of the groups $R^5$ or $R^6$ is a photographically active group or the compound corresponding to formula II

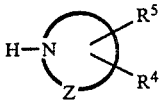

II is a photographically active compound after it has been released as a whole, in particular a silver halide development inhibitor;

$R^7$ denotes alkyl, cycloalkyl, aralkyl, alkenyl, alkinyl or aryl;

$R^8$ denotes alkyl, aralkyl or aryl;

$R^9$ denotes H or a group such as $R^8$ or $R^8$ and $R^9$ together denote the group for completing a cyclic amino group.

An alkyl group denoted by $R^5$, $R^6$, $R^7$, $R^8$ or $R^9$ in formula II may be straight chained or branched and may contain up to 10 carbon atoms; examples are: methyl, ethyl, propyl, isopropyl, butyl, s-butyl, t-butyl, pentyl, hexyl and octyl. The alkyl groups may be substituted, e.g. by hydroxyl, alkoxy, alkylthio, acylamino or a cyclic imide group.

An example of a cycloalkyl group denoted by $R^7$ is cyclohexyl; an example of an aryl group ($R^7$, $R^8$) is benzyl; allyl and 2-butenyl are examples of alkenyl groups and propinyl is an example of an alkinyl group.

The piperidino group and the morpholine group are examples of cyclic amino groups ($R^8$, $R^9$).

Examples of cyclic imido groups include the succinimido group, the maleimido group, the phthalimido group, the hexabydrophthalimido group and a group corresponding to the following formula

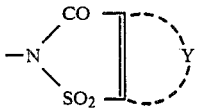

wherein

Y denotes the group required for completing a carbocyclic or heterocyclic, optionally substituted ring.

The heterocyclic group denoted by $R^5$ or $R^6$ may be, for example, a furyl, thiazolyl or 1,2,4-triazolyl group. Such a heterocyclic group may contain further substituents, e.g. alkyl, alkoxy or alkylthio (—S—$R^7$).

In particularly preferred couplers according to the present invention, $R^5$ denotes alkylthio and $R^6$ denotes H, alkyl, alkylthio, aryl or a heterocyclic group, under the condition that at least one of the groups $R^5$ and $R^6$ contains, at a distance of 2 to 4 atoms from the triazole ring, a group which is hydrolyzed in aqueous alkali; see German Patent Application P 39 18 394.7.

The DIR couplers according to the invention from the series of benzo-1,2,4-sulphone diazine-3-acetic acid anilides are readily soluble in esters and alcohols so that their introduction into photographic layers entails no difficulties and no restrictions in the choice of coupler solvent.

The same applies to the other types of DIR couplers corresponding to the general formula I in which the function —CO—R[1]) completes a ketone or a diacyl hydrazine.

At pH above 8.5 coupling of the new DIR couplers takes place substantially independently of the pH of the developer. The sensitometric properties of a material containing these couplers are less affected by fluctuations in the alkali content of the developer than are the sensitometric propeties of a material prepared with conventional couplers.

The coupling colour of the chromogenic dyes formed from the new DIR couplers is in the region of orange to scarlet red and therefore contributes relatively little to the image information of the negative.

The advantageous properties of the couplers according to the invention are presumably due not least to the fact that the triazole ring is evidently not only a good leaving group so that the couplers are highly reactive but also evidently has a certain tendency to be adsorbed on the silver halide grain so that it influences the processes taking place in the course of development of the silver halide. The groups which determine the activity of the photographically active compounds are obviously brought into very advantageous contact with the surface of the silver halide grain. It is therefore preferred according to the invention to use a photographically active compound which influences the development of silver halide, e.g. a development accelerator, a foggant, a bleaching accelerator or a development inhibitor, the latter being particularly preferred. In the latter case specifically it is also preferred if at least one of the groups $R^5$ and $R^6$ is —S—$R^7$ and at least one of the groups contains a saponifiable group.

Since the couplers according to the invention are highly active, they may be used at comparatively low concentrations. This inter alia facilitates their use in those layers of the colour photographic recording material in which mainly magenta or cyan dyes are produced, without any significant impairment to the colour image by unwanted side densities.

The following are examples of particularly suitable DIR couplers for the purpose of the invention:

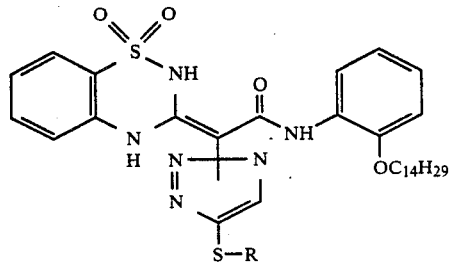

R = —CH(C$_4$H$_9$)—COOC$_2$H$_5$ DIR-1

R = —CH(CH$_3$)—COOC$_5$H$_{11}$ DIR-2

R = —CH$_2$—COOC$_6$H$_{13}$ DIR-3

DIR-4

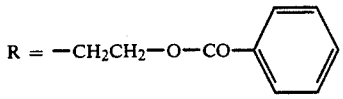

R = —CH$_2$CH$_2$—O—CO—

R = —CH(C$_4$H$_9$)—COOCH$_2$CF$_3$ DIR-5

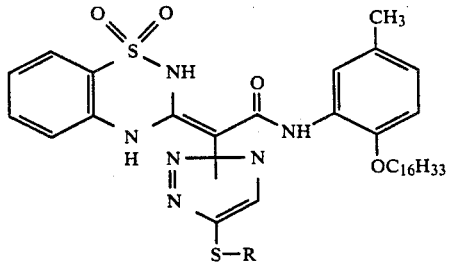

R = —CH$_2$COOC$_6$H$_{13}$ DIR 6

R = —CH—COOC$_5$H$_{11}$ DIR-7

DIR-8

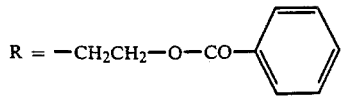

R = —CH$_2$CH$_2$—O—CO—

-continued
DIR-9
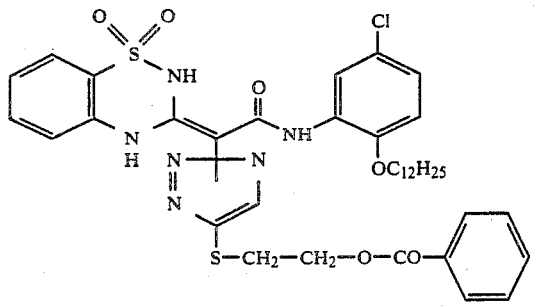
DIR-10
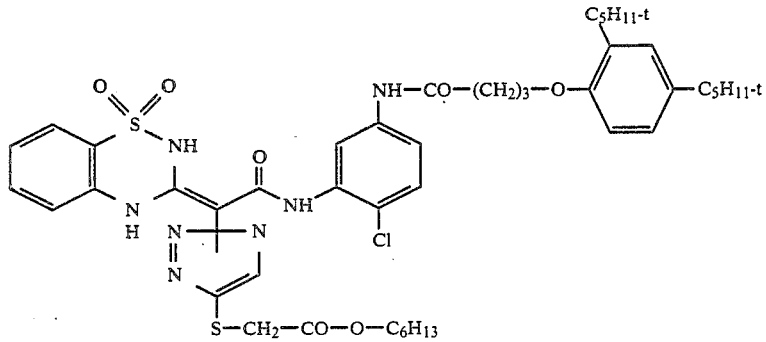
DIR-11
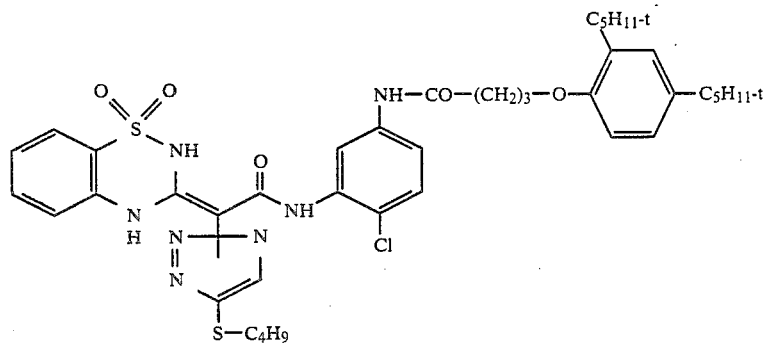
DIR-12
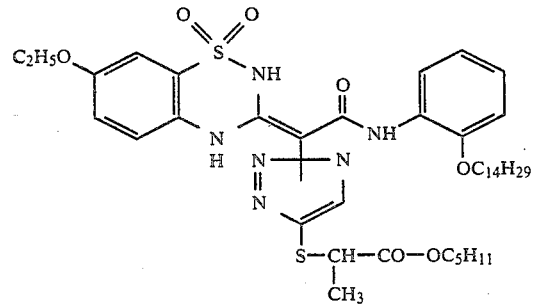
DIR-13
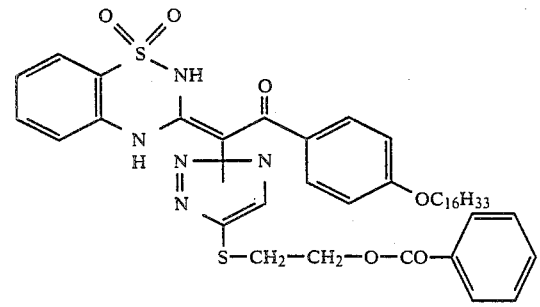

-continued
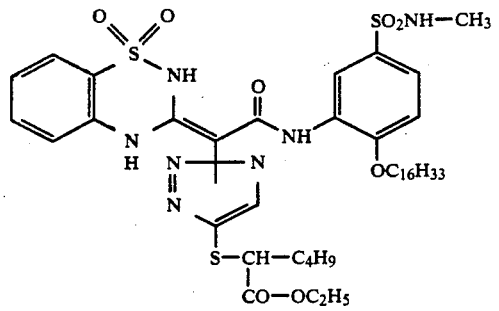
DIR-14
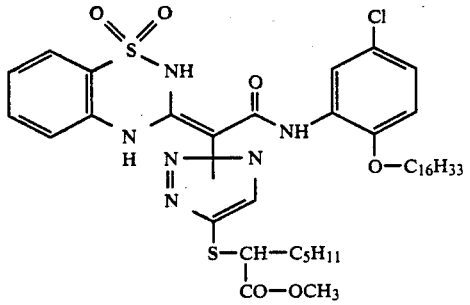
DIR-15
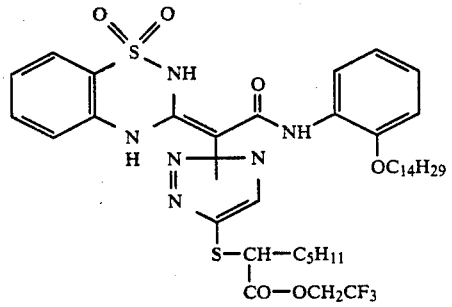
DIR-16
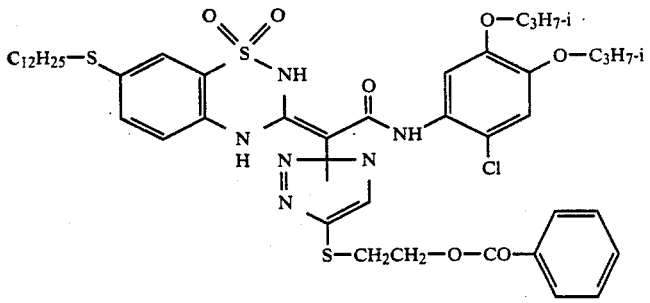
DIR-17
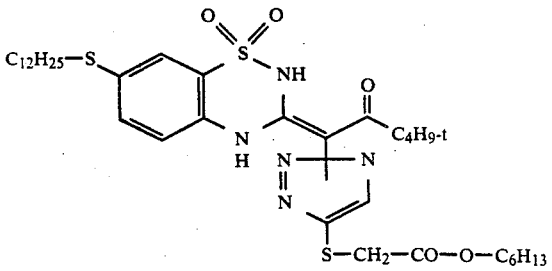
DIR-18

-continued

DIR-19

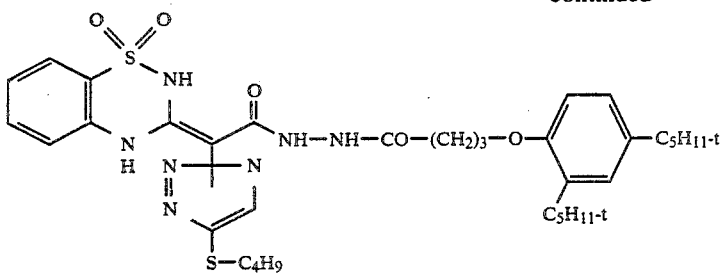

DIR-20

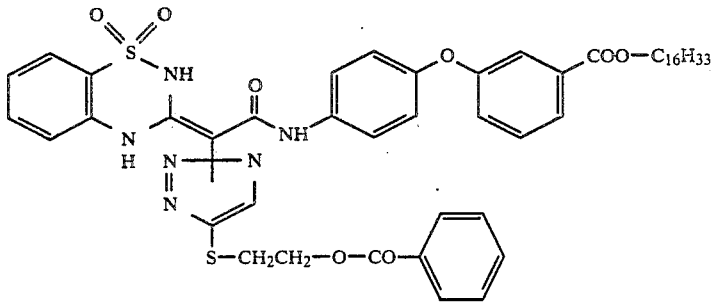

Synthesis of the DIR couplers is carried out by known processes.

The starting materials are 2-aminobenzene sulphonamides, which may conveniently be obtained either from 2-amino-or 2-acylaminobenzene sulpho chlorides or by the hydrogenation of 2-nitrobenzene sulphonamides. Substituents may be present in the 2-aminobenzene sulphonamide from the beginning or introduced by electrophilic substitution. Thus, for example, the alkylthio group of 2-amino-5-alkylthio benzene sulphonamides may be introduced by sequence thiocyanation, alkaline hydrolysis or alkylation while an acylamino group may be introduced by nitration, reduction and acylation.

The ketone, anilide or acyl hydrazide function is introduced via the second structural unit derived from an acyl ethyl acetate or a malonic ester.

3-pivaloylmethyl-benzo-1,2,4-sulphone-diazines, for example, are preferably prepared by alkaline catalysed condensation of pivaloyl ethyl acetate with 2-aminobenzene sulphonamides; benzo-1,2,4-sulphone diazine-3-acetanilide are prepared either by the reaction of a malonimino-ether anilide with a 2-aminobenzene sulphonamide or in two stages by the reaction of a malonimino-ether ester with a 2-aminobenzene sulphonamide followed by aminolysis of the resulting benzo-1,2,4-sulphone diazine-3-ethyl acetate.

The introduction of 1,2,3-triazole which acts as inhibitor is also preferably carried out by a conventional method of halogenation, preferably bromination, followed by nucleophilic substitution, preferably under aprotic conditions. The stages of this synthesis all take place via well defined and stable compounds and in high yields.

Examples of syntheses

1. Benzo-1,2,4-thiadiazine-1,1-dioxide-3-ethyl acetate (3.1).

20 g of malonic acid diethyl ester imidohydrochloride and 17 g of 2-aminobenzene sulphonamide are heated under reflux in 150 ml of ethanol for 45 minutes and the reaction mixture is poured out onto 300 g of ice. 12 g of white needles melting at 130° to 135° C. are obtained after suction filtration and crystallization from ethanol.

2. Benzo-1,2,4-thiadiazine-1,1-dioxide-3-acetic acid -(2-tetradecyloxy)-anilide (3.2).

10 g of the compound obtained under 3.1 and 11 g of 2-tetradecyloxy aniline are heated to 180° C. in 50 ml of orthodichlorobenzene for 2 hours. The reaction mixture is then cooled to 70° C. and poured out onto 100 ml of methanol. 13 g of a pale yellowish powder melting at 117° to 119° C. are obtained after suction filtration and drying in air.

3. Benzo-1,2,4-thiadiazine-1,1-dioxide-3-bromoacetic acid-(2-tetradecyloxy)-anilide (3.3).

3.4 g of bromine in 1n ml of acetic acid are added dropwise at room temperature to a suspension of 10g of the compound obtained under 3.2 in 100 ml of acetic acid. 3 g of sodium acetate are added after 30 minutes and 100 g of ice are introduced. The liquid is decanted from the precipitated product which is then stirred up with 30 ml of methanol.

An almost white powder melting at 138° to 140° C. with decomposition is obtained after drying in air. Yield: 9.5 g.

4. Compound DIR-4

6 g of the brominated coupler obtained under 3.3 and 2.6 g of 4-(2-benzoyloxy)-ethylthio-1,2,3-triazole prepared by the reaction of Na-4-mercapto-1,2,3-triazole with 2-chloroethyl benzoate are stirred together in 30 ml of dimethyl acetamide at room temperature for 2 hours with the addition of 4 g of potassium carbonate. The reaction mixture is then poured out on 100 g of ice and 5 ml of acetic acid and left to stand for about 3 hours until crystallization sets in. The liquid is then decanted off and the product washed twice with 100 ml portions of water and digested with 10 ml of isopropanol.

3.8 g of compound 3 melting at 150° C. (decomp.) are obtained.

After the product has been sprayed with colour developer CD3 and alkaline persulphate solution 2, isomers which couple to form orange-coloured products can be recognised by thin layer chromatography ( silica gel, solvent: toluene/ethyl acetate).

The compounds according to the present invention are suitable for use as DIR couplers in colour photographic materials, in particular multilayered materials. Since the couplers are mainly yellow couplers, they are preferably used in or in association with a light sensitive silver halide emulsion layer which is predominantly sensitive to the blue spectral region of visible light. The special advantage of the couplers according to the invention, namely their comparatively low inhibition of development in the layer with which such a compound is associated combined with comparatively powerful inhibition of development in adjacent layers not associated with the coupler, is, of course, particularly beneficial in the case of a multilayered colour photographic recording material which in addition to containing a predominantly blue sensitive silver halide emulsion layer contains other light sensitive silver halide emulsion layers with predominant sensitivity to the green or red spectral region of visible light. Couplers which give rise to little colour on development may selectively be associated with a blue sensitive, a green sensitive or a red sensitive layer or to several such layers without any risk of colour falsification.

In the process of preparation of the light sensitive colour photographic recording material, the diffusion fast DIR couplers of the present invention may be incorporated with the casting solution of the silver halide emulsion layers or other colloid layers together with other couplers in known manner. For example, oil soluble or hydrophobic couplers may advantageously be added to a hydrophilic colloid solution from a solution in a suitable coupler solvent (oil former), optionally in the presence of a wetting or dispersing agent. The hydrophilic casting solution may, of course, contain conventional additives in addition to the binder. The solution of coupler need not be directly dispersed in the casting solution for the silver halide emulsion layer or another water permeable layer but may advantageously first be dispersed in an aqueous, light insensitive solution of a hydrophilic colloid and the resulting mixture may then be mixed with the casting solution for the light sensitive silver halide emulsion layer or some other water permeable layer, optionally after removal of the low boiling organic solvent used, and the resulting casting solution may then be applied.

The light sensitive silver halide emulsions used may be emulsions of silver chloride, silver bromide or mixtures thereof, optionally with a small silver iodide content of up to 15 mol%, in one of the conventionally used hydrophilic binders. The binder used for the photographic layers is preferably gelatine but this may be partly or completely replaced by other natural or synthetic binders.

The emulsions may be chemically and spectrally sensitized in the usual manner and the emulsion layers as well as other light insensitive layers may be hardened with known hardeners in the usual manner.

Colour photographic recording materials normally contain at least one silver halide emulsion layer for the recording of light of the three spectral regions, red, green and blue. For this purpose, the light sensitive layers are spectrally sensitized in known manner with suitable sensitizing dyes. Blue sensitive silver halide emulsion layers need not necessarily contain a spectral sensitizer since the intrinsic sensitivity of silver halide is in many cases sufficient for the recording of blue light.

Each of the above mentioned light sensitive layers may consist of a single layer or may comprise two or more silver halide emulsion partial layers in known manner, e.g. as in the so called double layer arrangement (DE-C-1 121 470). Red sensitive silver halide emulsion layers are normally arranged closer to the layer support than green sensitive silver halide emulsion layers, which in turn are arranged closer to the support than blue sensitive layers, and a light insensitive yellow filter layer is generally arranged between green sensitive layers and blue sensitive layers. Other arrangements could, however, conceivably be used. A light insensitive interlayer which may contain substances to prevent accidental diffusion of developer oxidation products is generally arranged between layers differing in their spectral sensitivity. When a material contains several silver halide emulsion layers of the same spectral sensitivity, these may be arranged directly adjacent to one another or separated by a light sensitive layer of a different spectral sensitivity (DE-A-1 958 709, DE-A-25 30 645 and DE-A-26 22 922).

Colour photographic recording materials for the preparation of multicolour images normally contain colour producing compounds in spatial and spectral association with the silver halide emulsion layers of differing spectral sensitivities for producing the different partial colour images in cyan, magenta and yellow, these colour producing compounds being in the present case mainly colour couplers.

By "spatial association" is meant that the colour couplers are in such spatial relationship to the silver halide emulsion layer that the coupler and emulsion layer are capable of interacting to give rise to an imagewise correspondence between the silver image produced on development and the colour image produced from the colour coupler. This is generally achieved by introducing the colour coupler into the silver halide emulsion layer or into an adjacent, optionally light insensitive layer of binder.

By "spectral association" is meant that the spectral sensitivity of each of the light sensitive silver halide emulsion layers and the colour of the partial colour image produced from the spatially associated colour coupler stand in a certain relationship to one another, each of the spectral sensitivities (red, green, blue) being associated with a different colour of the corresponding partial colour image (e.g. cyan, magenta, yellow).

Each of the differently spectrally sensitized silver halide emulsion layers may have one or more colour couplers associated therewith. When a photographic material contains several silver halide emulsion layers of the same spectral sensitivity, each of these layers may contain a colour coupler but these colour couplers need not be identical, provided only that on colour development they give rise to at least approximately the same colour, normally a colour which is complementary to the colour of the light to which the corresponding silver halide emulsion layers are predominantly sensitive.

In preferred embodiments, red sensitive silver halide emulsion layers are associated with at least one non-diffusible colour coupler for producing the cyan partial colour image, green sensitive silver halide emulsion layers are associated with at least one non-diffusible colour coupler for producing the magenta partial colour image and blue sensitive silver halide emulsion layers are associated with at least one non-diffusible colour coupler for producing the yellow partial colour image, but other associations are also known.

Colour couplers for producing the cyan partial image are generally couplers of the phenol or α-naphthol series. The following are suitable examples:

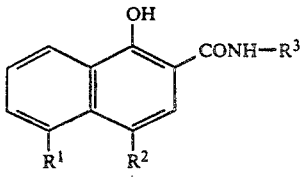

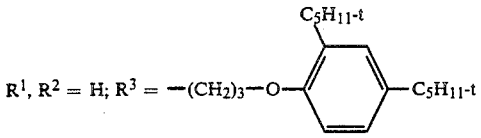

$R^1, R^2 = H; R^3 = -(CH_2)_3-O-C_6H_4-C_5H_{11}\text{-t}$ (with $C_5H_{11}$-t on the ring) C-1

$R^1 = -NHCOOCH_2-CH(CH_3)_2; R^2 = H; R^3 = -(CH_2)_3-OC_{12}H_{25}$ C-2

$R^1 = H; R^2 = -OCH_2-CH_2-SO_2CH_3; R^3 = -C_{16}H_{33}$ C-3

$R^1 = H; R^2 = -OCH_2-CONH-(CH_2)_2-OCH_3;$ C-4

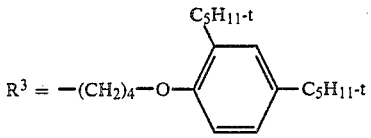

$R^3 = -(CH_2)_4-O-C_6H_4-C_5H_{11}\text{-t}$ (with $C_5H_{11}$-t on the ring)

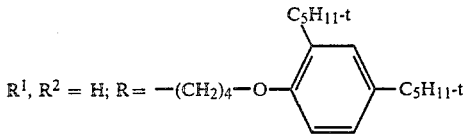

$R^1, R^2 = H; R = -(CH_2)_4-O-C_6H_4-C_5H_{11}\text{-t}$ (with $C_5H_{11}$-t on the ring) C-5

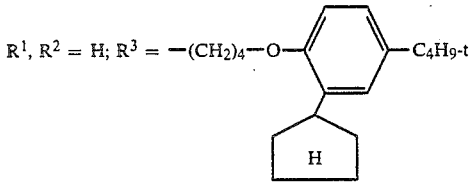

$R^1, R^2 = H; R^3 = -(CH_2)_4-O-C_6H_4-C_4H_9\text{-t}$ (with $C_4H_9$-t on the ring, H) C-6

$R^1 = H; R^2 = Cl; R^3 = -C(C_2H_5)_2-C_{21}H_{43}$ C-7

$R^1 = H; R^2 = -O-CH_2-CH_2-S-CH(COOH)-C_{12}H_{25}$ C-8

$R^3$ = Cyclohexyl

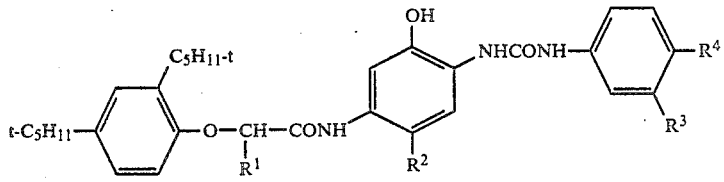

$R^1 = -C_4H_9; R^2 = H; R^3 = -CN; R^4 = Cl$ C-9

$R^1 = -C_4H_9; R^2 = H; R^3 = H; R^4 = -SO_2CHF_2$ C-10

C-11

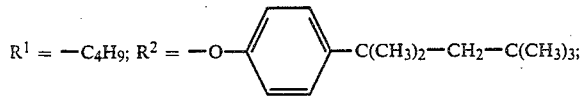

$R^1 = -C_4H_9; R^2 = -O-C_6H_4-C(CH_3)_2-CH_2-C(CH_3)_3;$ $R^3 = H; R^4 = -CN$ $R^1 = C_2H_5; R^2, R^3 = H; R^4 = -SO_2CH_3$ C-12

$R^1 = -C_4H_9; R^2, R^3 = H; R^4 = -SO_2-C_4H_9$ C-13

$R^1 = -C_4H_9; R^2 = H; R^3 = -CN; R^4 = -CN$ C-14

-continued $R^1 = -C_4H_9$; $R^2, R^3 = H$; $R^4 = -SO_2-CH_2-CHF_2$ C-15

$R^1 = -C_2H_5$; $R^2, R^3 = H$; $R^4 = -SO_2CH_2-CHF-C_3H_7$ C-16

$R^1 = -C_4H_9$; $R^2, R^3 = H$; $R^4 = F$ C-17

$R^1 = -C_4H_9$; $R^2, R^3 = H$; $R^4 = -SO_2CH_3$ C-18

$R^1 = -C_4H_9$; $R^2, R^3 = H$; $R^4 = -CN$ C-19

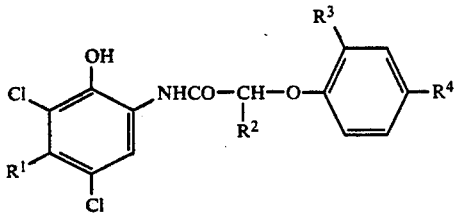

$R^1 = -CH_3$; $R^2 = -C_2H_5$; $R^3, R^4 = -C_5H_{11}$-t C-20

$R^1 = -CH_3$; $R^2 = H$; $R^3, R^4 = -C_5H_{11}$-t C-21

$R^1, R^2 = -C_2H_5$; $R^3, R^4 = -C_5H_{11}$-t C-22

$R^1 = -C_2H_5$; $R^2 = -C_4H_9$; $R^3, R^4 = -C_5H_{11}$-t C-23

$R^1 = -C_2H_5$; $R^2 = -C_4H_9$; $R^3, R^4 = C_4H_9$-t C-24

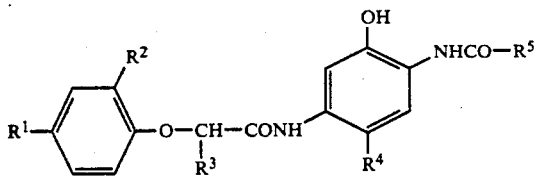

$R^1, R^2 = -C_5H_{11}$-t; $R^3 = -C_4H_9$; $R^4 = H$; $R^5 = -C_3F_7$ C-25

$R^1 = -NHSO_2-C_4H_9$; $R^2 = H$; $R^3 = -C_{12}H_{25}$; $R^4 = Cl$; $R^5 =$ phenyl C-26

$R^1, R^2 = -C_5H_{11}$-t; $R^2 = Cl$; $R^3 = -C_3H_7$-i; $R^4 = Cl$; $R^5 =$ pentafluorophenyl C-27

$R^1 = -C_5H_{11}$-t; $R^2 = Cl$; $R^3 = -C_6H_{13}$; $R^4 = Cl$; $R^5 =$ -2-chlorophenyl C-28

Colour couplers for producing the magenta partial colour image are generally couplers of the 5-pyrazolone, the indazolone or the pyrazoloazole series. The following are suitable examples:

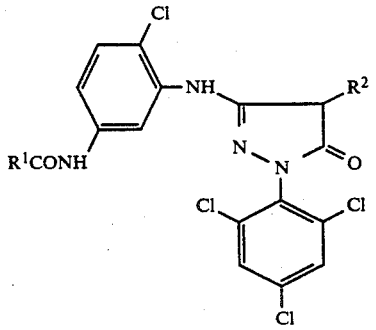

M-1:

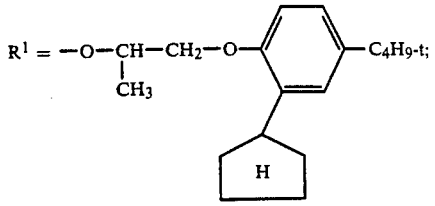

-continued
$R^2 = H$
M-2:
$R^1 =$ 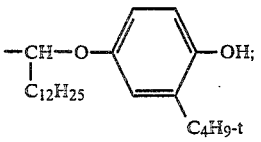
$R^2 = H$
M-3: $R^1 = -C_{13}H_{27}$;
$R^2 = H$
M-4: $R^1 = -OC_{16}H_{33}$;
$R^2 = H$
M-5: $R^1 = -C_{13}H_{27}$;
$R^2 =$ 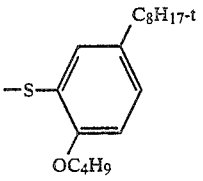
M-6:
$R^1 =$ 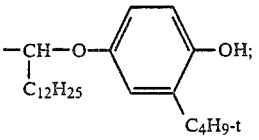
$R^2 =$ 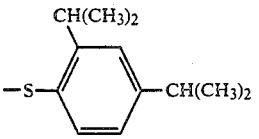
M-7: $R^1 = -C_9H_{19}$;
$R^2 =$ 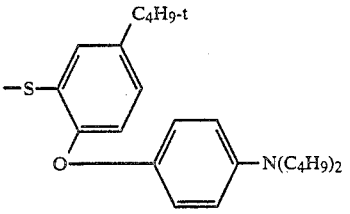
M-8:
$R^1 =$ 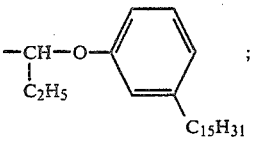 ;
$R^2 =$ 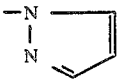

-continued
M-9:
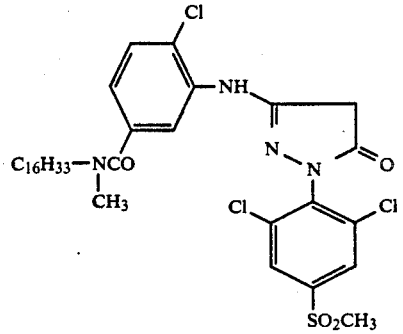
M-10:
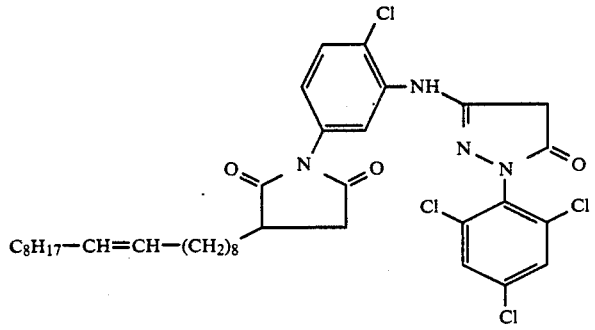
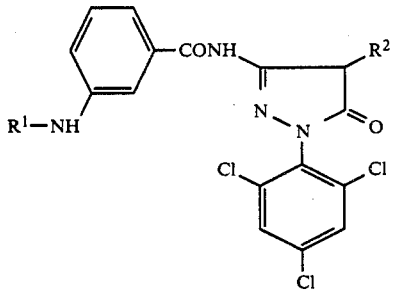
M-11:
$R^1$ = 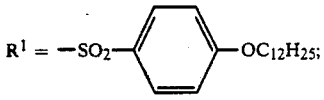
$R^2$ = H
M-12:
$R^1$ = 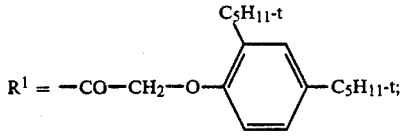
$R^2$ = H
M-13:
$R^1$ = 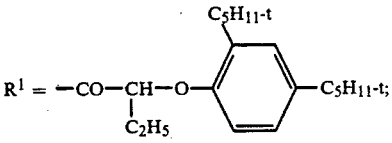
$R^2$ = H
M-14:
$R^1$ = 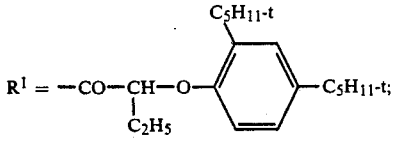

-continued
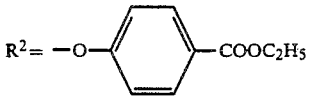
M-15:
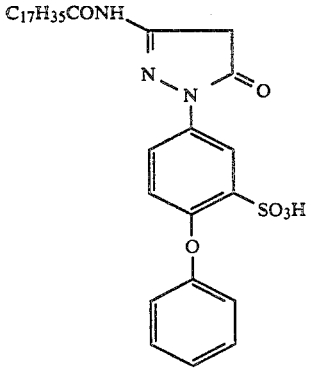
M-16:
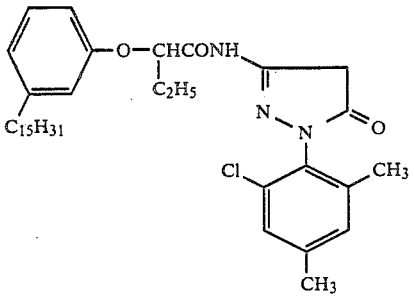
M-17:
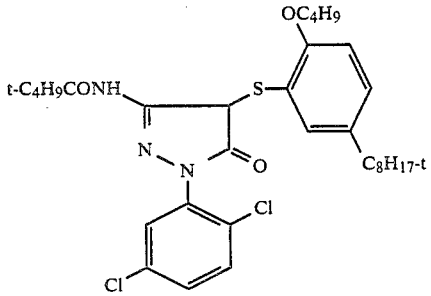
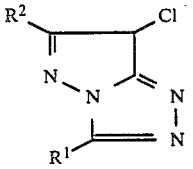
M-18:
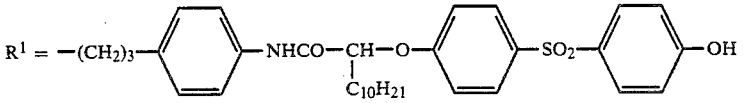
$R^2 = -CH_3$
M-19:
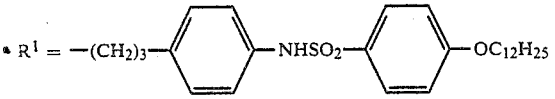
$R^2 = -CH_3$ -continued

M-20:

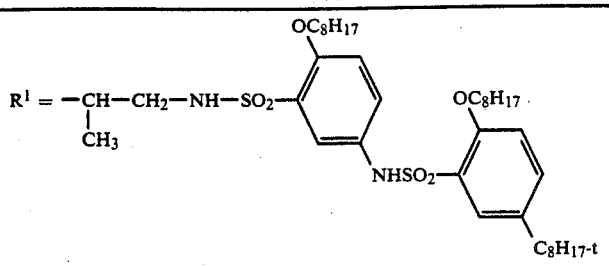

$R^2 = -C_4H_9$-t

M-21:

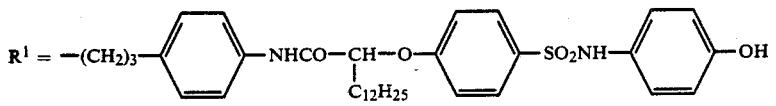

$R^2 = -CH_3$

M-22:

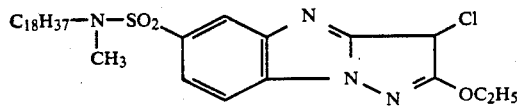

Colour couplers for producing the yellow partial colour image are generally couplers containing an open chain ketomethylene group, in particular couplers of the type of α-acyl acetamide. Suitable examples of these are α-benzoyl acetanilide couplers and α-pivaloyl acetanilide couplers corresponding to the following formulae:

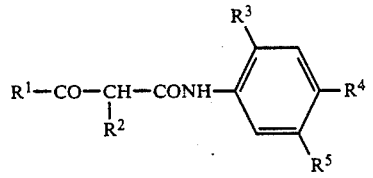

Y-1: $R^1 = -C_4H_9$-t;

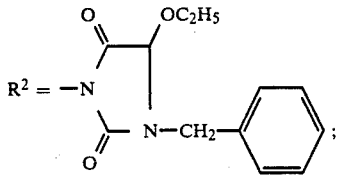

$R^3 = Cl$;
$R^4 = H$;

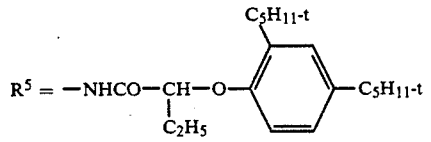

Y-2: $R^1 = -C_4H_9$-t;

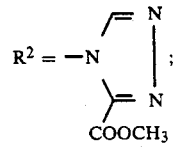

$R^3 = -OC_{16}H_{33}$;
$R^4 = H$;
$R^5 = -SO_2NHCH_3$

Y-3: $R^1 = -C_4H_9$-t;

-continued
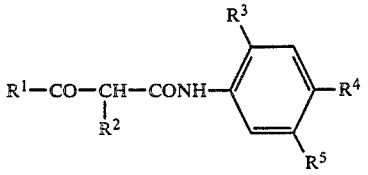
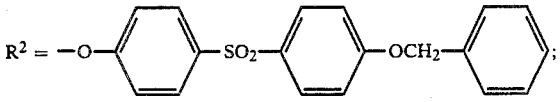
$R^3$ = Cl
$R^4$ = H;
$R^5$ = $-NHSO_2-C_{16}H_{33}$
Y-4: $R^1$ = $-C_4H_9$-t;
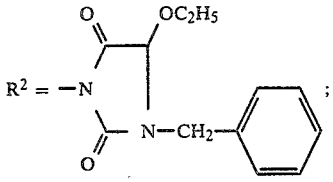
$R^3$ = Cl;
$R^4$ = H;
$R^5$ = $-COOC_{12}H_{25}$
Y-5: $R^1$ = $-C_4H_9$-t;
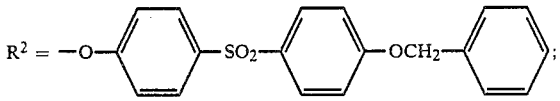
$R^3$ = Cl;
$R^4$ = H;
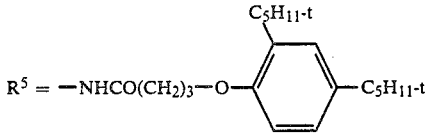
Y-6: $R^1$ = $-C_4H_9$-t;
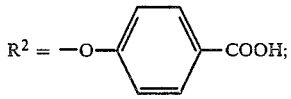
$R^3$ = Cl;
$R^4$ = H;
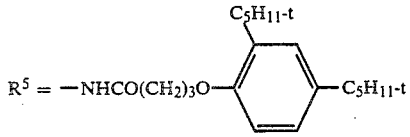
Y-7: $R^1$ = $-C_4H_9$-t;
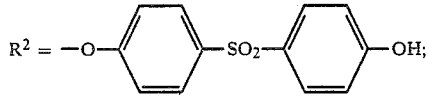
$R^3$ = Cl;
$R^4$ = H;
$R^5$ = $-NHSO_2-C_{16}H_{33}$
Y-8: $R^1$ = $-C_4H_9$-t;

-continued
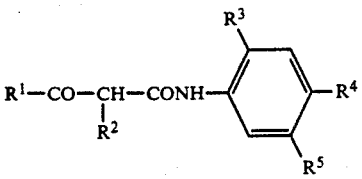
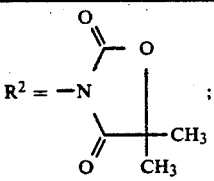
$R^3$ = Cl;
$R^4$ = H;
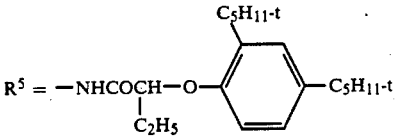
Y-9: $R^1$ = $-C_4H_9$-t;
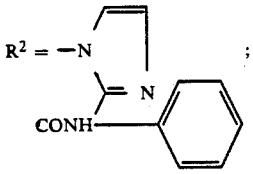
$R^3$ = $-OC_{16}H_{33}$;
$R^4$ = H;
$R^5$ = $-SO_2NHCOC_2H_5$
Y-10: $R^1$ = $-C_4H_9$-t;
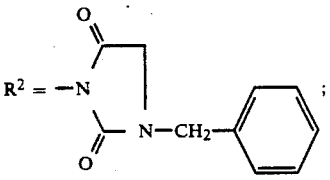
$R^3$ = Cl;
$R^4$ = H
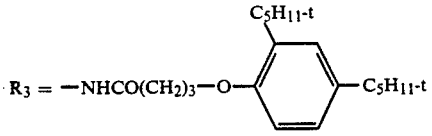
Y-11: $R^1$ = $-C_4H_9$-t;
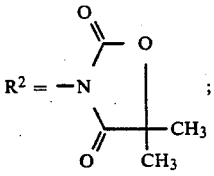
$R^3$ = Cl;
$R^4$ = H;
$R^5$ = $-COOCH(C_4H_9)-COOC_{12}H_{25}$ -continued
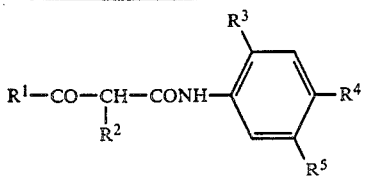
Y-12: $R^1 = -C_4H_9\text{-t}$;
$R^2 =$ 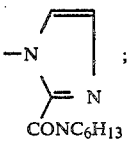 ;
$R^3 = Cl$;
$R^4 = H$;
$R^5 =$ 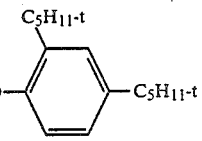
Y-13: $R^1 = -C_4H_9\text{-t}$;
$R^2 =$ 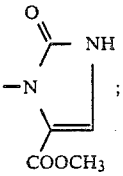 ;
$R^3 = -OC_{16}H_{33}$;
$R^4 = H$;
$R^5 = -SO_2NHCH_3$
$R_3 =$ 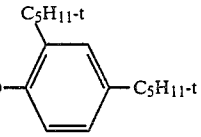
Y-14: $R^1 = -C_4H_9\text{-t}$;
$R^2 =$ 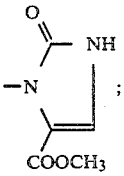 ;
$R^3 = Cl$;
$R^4 = H$;
$R^5 =$ 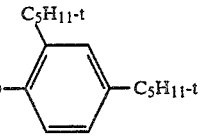
Y-15:
$R^1 =$ 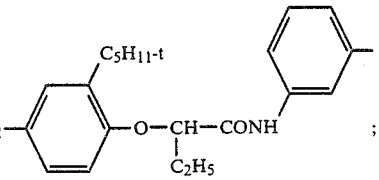 ;

-continued
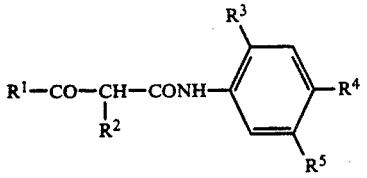
$R^2$, $R^4$, $R^5$ = H;
$R^3$ = $-OCH_3$
Y-16:
$R^1$ = 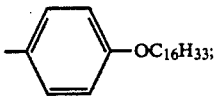 $-OC_{16}H_{33}$;
$R^2$ = 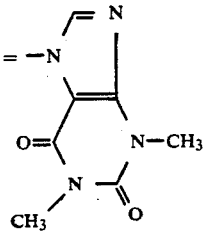
$R^3$, $R^5$ = $-OCH_3$;
$R^4$ = H
Y-17:
$R^1$ = 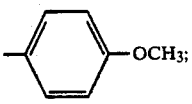 $-OCH_3$;
$R^2$ = 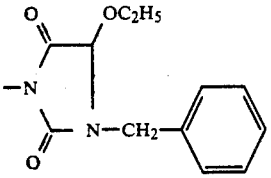
$R^3$ = Cl;
$R^4$ = H;
$R^5$ = $-COOC_{12}H_{25}$
Y-18:
$R^1$ = 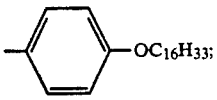 $-OC_{16}H_{33}$;
$R^2$ = 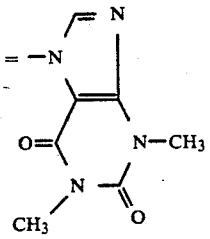
$R^3$ = Cl;
$R^4$, $R^5$ = $-OCH_3$
Y-19:
$R^1$ = 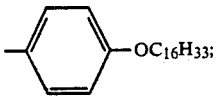 $-OC_{16}H_{33}$;

-continued

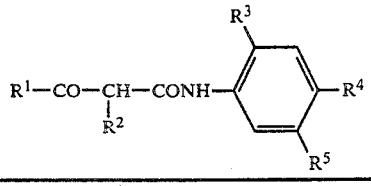

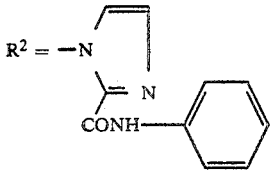

$R^3 = -OCH_3$;
$R^4 = H$;
$R^5 = -SO_2N(CH_3)_2$

Y-20:

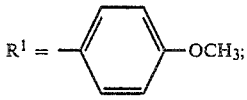

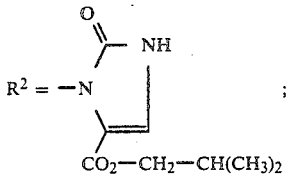

$R^3 = -OCH_3$;
$R^4 = H$;

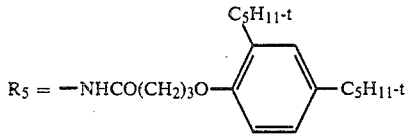

Y-21:

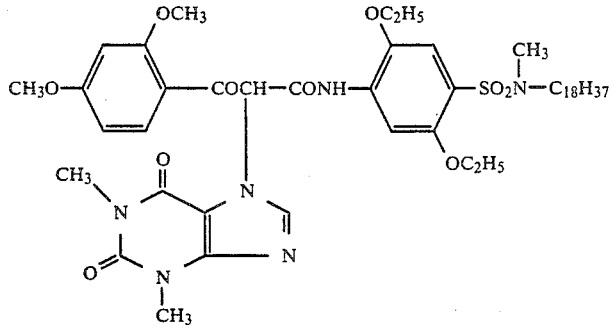

The colour couplers may be 4-equivalent couplers or 2-equivalent. couplers. The latter are derived from 4-equivalent couplers in that they carry in the coupling position a substituent which is split off in the coupling reaction. 2-equivalent couplers include couplers which are colourless as well as those which have an intense colour of their own which disappears in the process of colour coupling to be replaced by the colour of the image dye produced (masking couplers) and white couplers which give rise to substantially colourless products in the reaction with colour developer oxidation products. Also to be included among the 2-equivalent couplers are those couplers which carry in the coupling position a removable group which is released in the reaction with colour developer oxidation products and then develops a particular photographic activity, e.g. as development inhibitor or accelerator, either directly or after one or more further groups have been split off from the group originally released (e.g. DE-A-27 03 145, DE-A-28 55 697, DE-A-31 05 026 and DE-A-33 19 428). Examples of such 2-equivalent couplers include the known DIR couplers as well as DAR and FAR couplers.

Since the DIR, DAR and FAR couplers are important mainly for the activity of the group released in the coupling reaction and less for the colour producing properties of the couplers, DIR, DAR and FAR couplers of the kind which give rise to substantially colourless products in the coupling reaction may also be used (DE-A-1 547 640).

The removable group may also be a ballast group so that the reaction with colour developer oxidation products gives rise to coupling products which are diffusible or at least have a slight or limited mobility (U.S. Pat. No. -A-4 420 556).

According to the invention, the colour photographic recording material in addition contains at least one DIR coupler of formula I, and these couplers may be present not only in the yellow layer but also in the magenta layer and/or in the cyan layer or in a light insensitive layer adjacent to the aforesaid layers.

In addition to the components already mentioned, the colour photographic recording material according to the present invention may contain other additives, such as antioxidants, dye stabilizing agents and agents for influencing the mechanical and electrostatic properties. It is also advantageous to use UV absorbent compounds in one or more of the layers of the recording material, preferably in one of the upper layers, for the purpose of preventing or reducing the deleterious effect of UV light on the colour images produced with the colour photographic recording material according to the invention. Suitable UV absorbents are described in, for example, U.S. Pat. No. -A-3 253 921, DE-C-2 036 719 and EP-A-0 057 160.

The usual layer supports may be used for the materials according to the invention, see Research Disclosure No. 17 643, Section XVII.

The usual hydrophilic film forming agents may be used as protective colloids or binders for the layers of the recording material, e.g. proteins, in particular gelatine. Casting auxiliaries and plasticisers may be used; see the compounds indicated in Research Disclosure Nr. 17 643, Sections IX, XI and XII.

The layers of the photographic material may be hardened in the usual manner, for example with epoxide type hardeners, heterocyclic ethylene imine hardeners and acryloyl hardeners. The layers may also be hardened by the process according to DE-A-22 18.009 for producing colour photographic materials suitable for high temperature processing. Further, the photographic layers may be hardened with hardeners of the diazine, triazine or 1,2-dihydroquinoline series or with vinyl sulphone type hardeners.

Other suitable hardeners are disclosed in DE-A-24 39 551, DE-A-22 25 230, DE-A-23 17 672 and the above mentioned Research Disclosure 17 643, Section XI.

Other suitable additives are mentioned in Research Disclosure 17 643 and in "Product Licensing Index" of December 1971, pages 107-110.

For producing colour photographic images, the colour photographic recording material according to the invention is developed with a colour developer compound. The colour developer compound used may be any developer compound which is capable, in the form of its oxidation product, of reacting with colour couplers to form azomethine dyes. Suitable colour developer compounds include aromatic compounds of p-phenylene diamine series containing at least one primary amino group, for example, N,N-dialkyl-p-phenylene diamines such as N,N-diethyl-p-phenylene diamine, 1-(N-ethyl-N-methyl-sulphonamidoethyl)-3-methyl-p-phenylene diamine, 1-(N-ethyl-N-hydroxyethyl)-3-methyl-p-phenylene diamine and 1-(N-ethyl-N-methoxyethyl)-3-methyl-p-phenylene diamine.

Other suitable colour developers are described, for example, in J. Amer. Chem. Soc. 73, 3100 (1951) and in G. Haist, Modern Photographic Processing, 1979, John Wiley & Sons, N.Y., pages 545 et seq..

After colour development, the material is normally bleached and fixed. Bleaching and fixing may be carried out separately or together. The usual compounds may be used as bleaching agents, e.g. $Fe^{3+}$salts and $Fe^{3+}$-complex salts such as ferricyanides, dichromates, water soluble cobalt complexes, etc.. Iron-III complexes of amino polycarboxylic acids are particularly preferred, in particular e.g. those of ethylene diaminotetraceitc acid, N-hydroxyethyl-ethylene diamino triacetic acid and of alkyliminodicarboxylic acids and the complexes of corresponding phosphonic acids. Persulphates are also suitable bleaching agents.

EXAMPLE 1

A colour photographic recording material for colour negative colour development was prepared (layer arrangement 1 A - comparison) by applying the following layers in the given sequence to a transparent layer support of cellulose triacetate. The quantities given refer in each case to 1 $m^2$. The quantities of silver halide applied are given in terms of the corresponding quantities of $AgNO_3$. All silver halide emulsions were stabilized with 0.5 g of 4-hydroxy-6-methyl-1,3,3*a*,7-tetraazaindene per 100 g of $AgNO_3$.

Layer arrangement 1 A (comparison)

Layer 1: (antihalation layer) black colloidal silver sol containing
0.2 g of Ag
1.2 g of gelatine
0.1 g of UV absorbent UV-1
0.2 g of UV absorbent UV-2
0.02 g of tricresyl phosphate (TCP) and
0.03 g of dibutyl phthalate (DBP)

Layer 2: (micrate interlayer)
micrate silveriodobromide emulsion (0.5 mol% iodide; average particle diameter 0.07 μm) prepared from 0.25 g of $AgNO_3$ and 1.0 g of gelatine.

Layer 3: (red sensitized layer, medium sensitivity)
red sensitized silveriodobromide emulsion (4.0 mol% iodide; average grain diameter 0 45 μm) from
5.35 g of $AgNO_3$ containing
3.75 g of gelatine
1.33 g of cyan coupler C-19
0.05 g of red mask RM-1
0.118 g of DIR coupler DIR-A
1.33 g of TCP and
0.236 g of DBP Layer 4: interlayer) of
1.43 g of gelatine and
0.74 g of scavenger.

Layer 5: (Green sensitized layer, medium sensitivity)
green sensitized silveriodobromide emulsion
(4.0 mol% iodide; average grain diameter 0.45 μm)
from
3.10 g of $AgNO_3$ with
2.33 g of gelatine
0.775 g of magenta coupler M-12
0.050 g of yellow mask YM-1
0.068 g of DIR coupler DIR-A
0.775 g of TCP
0.136 g of DBP Layer 6: (Interlayer)
same as layer 4

Layer 7: (Yellow filter layer)
yellow colloidal silversol with 0.09 g of Ag and
0.34 g of gelatine Layer 8: (Blue sensitive layer, medium sensitivity)
blue sensitized silveriodobromide emulsion
(4.0 mol% iodide; average grain diameter 0.45 μm)
from
3.46 g of $AgNO_3$ with
1.73 g of gelatine
1.25 g of yellow coupler Y-20
0.076 g of DIR coupler DIR-A
1.25 g of TCP
0.152 g of DBP Layer 9: (Interlayer)
same as Layer 4

Layer 10: (Protective and hardening layer) of
0.68 g of gelatine
0.73 g of hardener (CAS Reg. No. 65411-60-1) and
0.50 g of formaldehyde acceptor FF.

The following compounds are used in Example 1 in addition to the couplers already mentioned:

UV absorbent UV-1

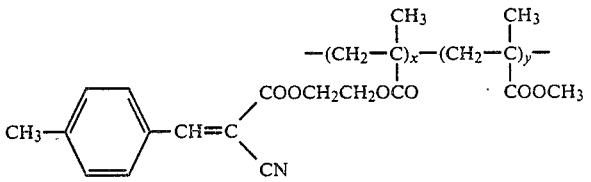

ratio by weight: x:y = 7.3

UV absorbent UV-2

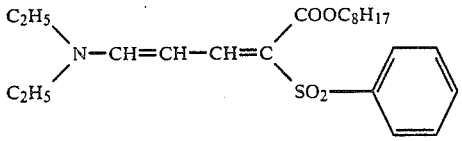

Red mask RM-1

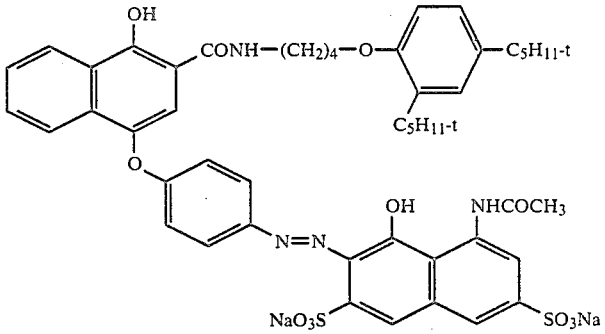

Yellow mask YM-1

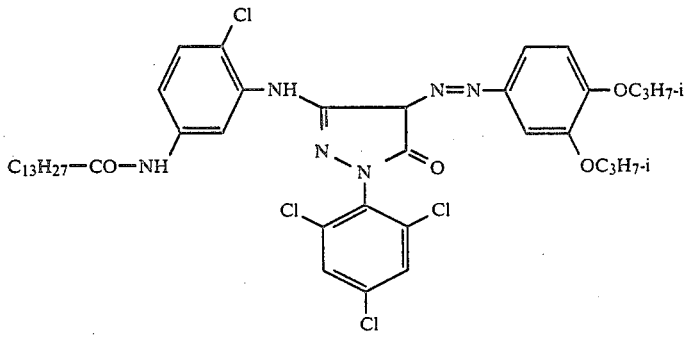

Scavenger SC-1

-continued

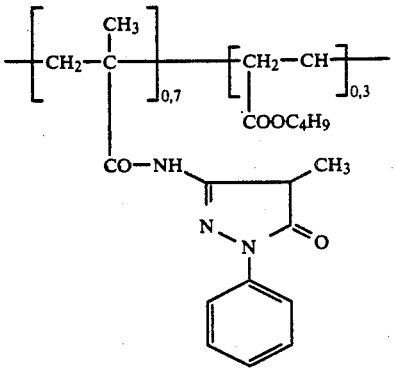

Formaldehyde acceptor FF

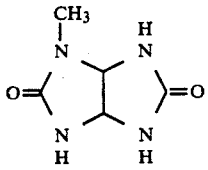

Na-perfluorobutane sulphonate is used as wetting agent in all the layers.

DIR coupler used in layer arrangement 1A (comparison):

DIR-A

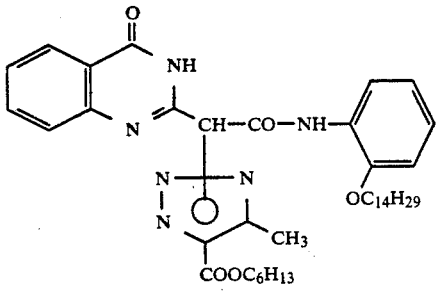

(DIR coupler D-1 from EP-A-0 287 833)

Other layer arrangements 1 B to 1 F were prepared similarly. They differed from Layer arrangement 1 A only by the DIR couplers used in Layers 3, 5 and 8.

Development was carried out after exposure of a grey wedge to reflected light as described in the "The British Journal of Photography", 1974, pages 597 and 598.

The results obtained after processing are shown in Table 1. The interimage effects IIE are calculated as follows:

$$IIE_{bg} = \frac{\gamma_{red} - \gamma_w}{\gamma_w}; \quad IIE_{pp} = \frac{\gamma_{green} - \gamma_w}{\gamma_w};$$

$$IIE_{gb} = \frac{\gamma_{blue} - \gamma_w}{\gamma_w};$$

In the above formulae:

$\gamma_{red}$ denotes gradation on selective exposure to red light $\gamma_{green}$ denotes gradation on selective exposure to green light $\gamma_{blue}$ denotes gradation on selective exposure to blue light $\gamma_w$ denotes gradation on exposure to white light.

The edge effect KE entered in Table 1 is the difference between the microdensity and macrodensity at macrodensity = 1 as described in James, The Theory of the Photographic Process, 4th Edition, Macmillan Publishing Co. Inc., 1977, page 611. In this table, $KE_{bg}$ means KE in the red sensitized layer and $KE_{pp}$ means KE in the green sensitized layer.

TABLE 1

| Layer Arrangement | DIR | $IIE_{gb}$ | $IIE_{pp}$ | $IIE_{bg}$ | $KE_{pp}$ | $KE_{bg}$ |
|---|---|---|---|---|---|---|
| 1 A | A | 3 | 44 | 35 | 0.39 | 0.44 |
| 1 B | 1 | 17 | 70 | 45 | 0.56 | 0.66 |
| 1 C | 4 | 11 | 99 | 44 | 0.74 | 0.81 |
| 1 D | 5 | 4 | 58 | 34 | 0.38 | 0.52 |
| 1 E | 8 | 8 | 64 | 37 | 0.47 | 0.61 |
| 1 F | 9 | 28 | 74 | 46 | 0.55 | 0.70 |

We claim:

1. Colour photographic recording material having at least one light sensitive silver halide emulsion layer and, associated therewith, a coupler capable of releasing a photographically active compound, wherein the coupler corresponds to the following general formula I

I

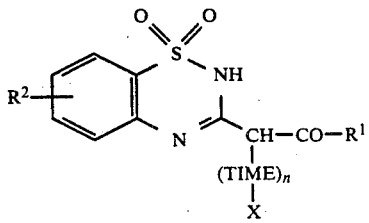

wherein $R^1$ denotes alkyl, aryl, NH-aryl or NH-NH-$R^3$;

$R^2$ denotes H, halogen, alkoxy, alkylthio or NH-$R^4$;

$R^3$ and $R^4$ denote acyl;

X denotes the residue of a photographically active compound containing a monocyclic 1,2,3- or 1,2,4-triazole ring;

TIME denotes a linking member which is released together with the attached residue X when the coupler reacts with the oxidation product of a colour developer and in turn releases the residue X as photographically active compound under the conditions of development;

n denotes 0 or 1.

2. Recording material according to claim 1, wherein the coupler is a DIR coupler (X is the residue of a development. inhibitor).

3. Recording material according to claim 1, wherein X stands for a group corresponding to the following formula:

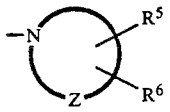

wherein

Z denotes the group for completing a 1,2,3- or 1,2,4-triazole ring;

$R^5$ and $R^6$ denote H, alkyl, aryl, a heterocyclic group, alkoxy, —S—$R^7$, amino, acylamino, a carboxylic acid ester group or —CO—$NR^8R^9$;

$R^7$ denotes alkyl, cycloalkyl, aralkyl, alkenyl, alkinyl or aryl;

$R^8$ denotes alkyl, aralkyl or aryl;

$R^9$ denotes H or a group such as $R^8$ or $R^8$ and $R^9$ together denote the group for completing a cyclic amino group.

4. Recording material according to claim 2, wherein the DIR coupler is contained in a predominantly blue sensitive silver halide emulsion layer and in that the recording material contains at least one other, predominantly green sensitive or predominantly red sensitive, silver halide emulsion layer.

5. Recording material according to claim 2, wherein the DIR coupler is contained in a predominantly red sensitive silver halide emulsion layer.

6. Colour photographic recording material having at least one predominantly blue sensitive silver halide emulsion layer unit with which at least one yellow coupler is associated, one predominantly green sensitive silver halide emulsion layer with which at least one magenta coupler is associated and one predominantly red sensitive silver halide emulsion layer with which at least one cyan coupler is associated, wherein at least one partial layer of the predominantly green sensitive silver halide emulsion layer unit or of the predominantly red sensitive silver halide emulsion layer unit contains a DIR coupler corresponding to the following formula I:

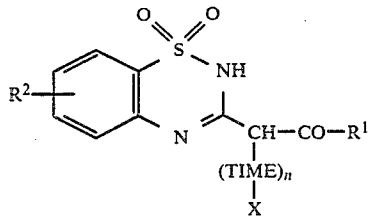

I wherein $R^1$ denotes alkyl, aryl, —NH—aryl or —NH—NH—$R^3$;

$R^2$ denotes H, halogen, alkoxy, alkylthio or —NH—$R^4$;

$R^3$ and $R^4$ denote acyl;

X denotes the residue of a photographically active compound containing a monocyclic 1,2,3- or 1,2,4-triazole ring;

TIME denotes a linking member which is released together with the residue X attached thereto when the coupler reacts with the oxidation product of a colour developer and which in turn releases the residue X as photographically active compound under the conditions of development and n denotes 0 or 1.

7. Recording material according to claim 2, characterised in that X stands for a group corresponding to the following formula:

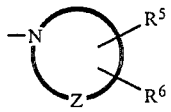

wherein

Z denotes the group for completing a 1,2,3- or 1,2,4-triazole ring;

$R^5$ and $R^6$ denote H, alkyl, aryl, a heterocyclic group, alkoxy, —S—$R^7$, amino, acylamino, a carboxylic acid ester group or —CO—$NR^8R^9$;

$R^7$ denotes alkyl, cycloalkyl, aralkyl, alkenyl, alkinyl or aryl;

$R^8$ denotes alkyl, aralkyl or aryl;

$R^9$ denotes H or a group such as $R^8$ or $R^8$ and $R^9$ together denote the group for completing a cyclic amino group.

* * * * *